US006772485B2

(12) United States Patent
Alpert

(10) Patent No.: US 6,772,485 B2
(45) Date of Patent: Aug. 10, 2004

(54) LUGGAGE SLIP STRAP

(76) Inventor: David Alpert, 4035 Stephens Mill Run, Atlanta, GA (US) 30342

( * ) Notice: Subject to any disclaimer, the term of this patent is extended or adjusted under 35 U.S.C. 154(b) by 0 days.

(21) Appl. No.: 10/283,576

(22) Filed: Oct. 30, 2002

(65) Prior Publication Data

US 2004/0083585 A1 May 6, 2004

(51) Int. Cl.[7] ..... A45C 13/30; A44C 21/00
(52) U.S. Cl. ..... 24/300; 24/182; 190/102
(58) Field of Search ..... 24/163 R, 164, 24/182, 300, 301, 302, 298; 294/149, 150; 190/102, 18 R; 224/411

(56) References Cited

U.S. PATENT DOCUMENTS 946,850 A 1/1910 Tabler
3,486,672 A * 12/1969 Esopi ..... 24/302
5,103,975 A 4/1992 Liu
5,269,449 A 12/1993 Sattler
5,431,317 A 7/1995 Kliot
5,437,401 A 8/1995 Seltzer
5,582,337 A * 12/1996 McPherson et al. ..... 224/660
5,603,545 A 2/1997 Benson et al.
5,788,032 A * 8/1998 Krulik ..... 190/108
5,887,770 A 3/1999 Covell
5,950,893 A 9/1999 Heggeland
6,032,916 A * 3/2000 Holliday ..... 248/505
6,371,346 B1 4/2002 Sharma
6,491,196 B1 * 12/2002 Coler ..... 224/602

* cited by examiner

*Primary Examiner*—Robert J. Sandy
(74) *Attorney, Agent, or Firm*—Michael M. Gerardi

(57) ABSTRACT

A luggage slip strap includes a flexible extended element having a long axis and first and second ends, and a sleeve affixed to the flexible extended element, the sleeve defining a cavity having an axis generally perpendicular to the long axis of the flexible extended member.

18 Claims, 2 Drawing Sheets

LUGGAGE SLIP STRAP

FIELD OF THE INVENTION

The present invention relates to devices for securing luggage, in particular to devices for securing a first article, such as a suitcase, to a second article, such as a luggage cart.

BACKGROUND OF THE INVENTION

It is often difficult to carry relatively bulky articles, such as suitcases, to or from an airport terminal, bus terminal or other location. Devices such as portable luggage carts can alleviate this difficulty. However, if multiple suitcases or other items need to be transported, it can be difficult to secure the items in a stable manner. The topmost suitcase may fall from the luggage cart if not stably secured, potentially resulting in damage to the suitcase or to items within the suitcase. Portable luggage carts typically employ cords or other devices to secure the items being transported, but these cords frequently prove inadequate.

Suitcases having integral handles and wheels are also known. Users of such suitcases often find it desirable to carry a second item atop the suitcase. Without adequate means for securing the second item in place, the item may also be dropped or damaged.

A need exists for an apparatus that facilitates the use of a portable luggage cart, or a suitcase having an integral handle and wheels, in moving multiple items, such as suitcases, in a stable and secure manner.

SUMMARY OF THE PREFERRED EMBODIMENTS

In accordance with one aspect of the present invention, there is provided a luggage slip strap that includes a flexible extended element having a long axis and first and second ends, and a sleeve affixed to the flexible extended element, the sleeve defining a cavity having an axis generally perpendicular to the long axis of the flexible extended member.

In particular embodiments, the flexible extended element is a strap, more particularly a strap in which the first and second ends include loops, very particularly loops formed using adjustable buckles.

According to specific embodiments, the means for securing the first and second ends of the flexible extended element to each other includes a buckle.

In accordance with another aspect of the present invention, there is provided a method for securing an article to an apparatus having a handle. The method includes the steps of: providing a luggage slip strap comprising a flexible extended element having a long axis and first and second ends, and a sleeve affixed to the flexible extended element, the sleeve defining a cavity having an axis generally perpendicular to the long axis of the flexible extended member; placing the sleeve about the handle; and securing around the article the flexible extended element.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
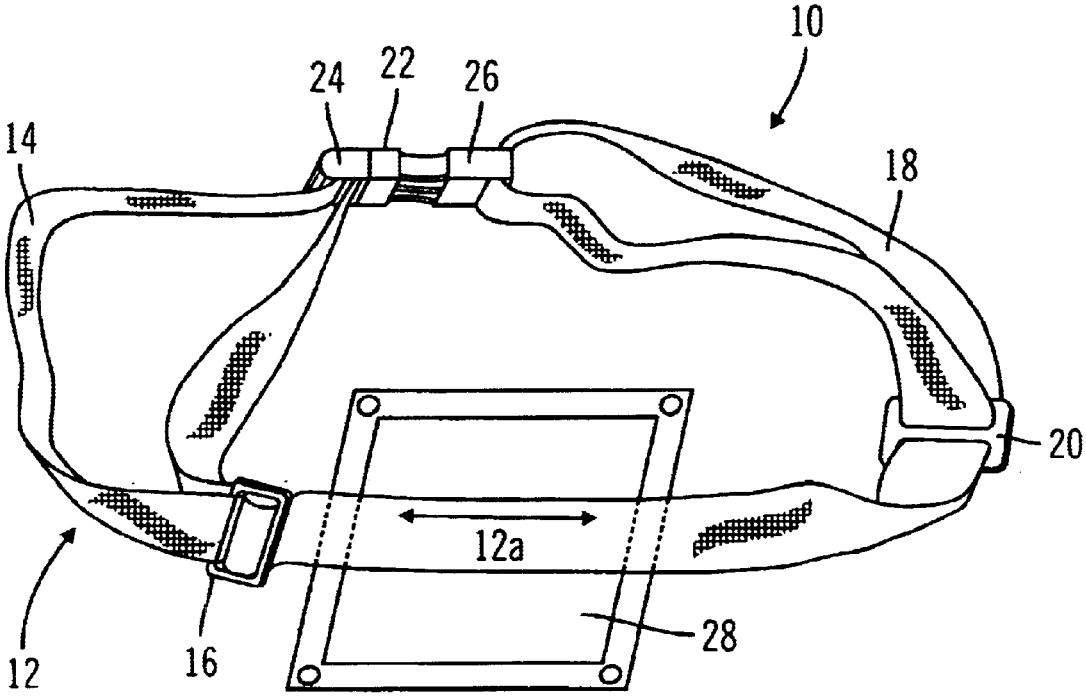
FIG. 1 is a top perspective view of a first embodiment of a luggage slip strap according to the invention including a strap with loops at each end and a buckle.
Figure 2:
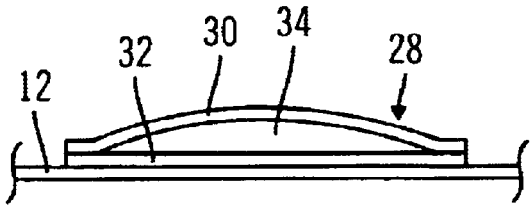
FIG. 2 is a top view of the sleeve of the first embodiment.
Figure 3:
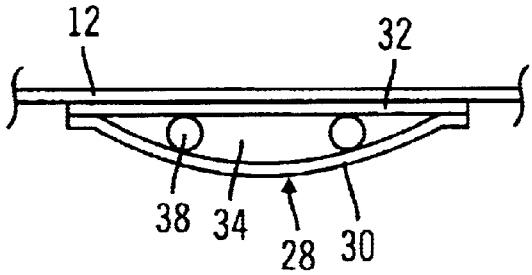
FIG. 3 is a top view of the sleeve of the first embodiment showing the orientation of a handle, e.g., of a portable luggage cart disposed within the cavity of the sleeve.

Turning now to FIGS. 1–3, a first embodiment 10 of a luggage slip strap according to the invention comprises a flexible extended element in the form of a strap 12. Strap 12 includes first and second loops 14 and 18, each of which is adjustably defined by respective adjustable buckles 16 and 20. Buckle 22 comprises female buckle element 24, which is adjustably secured to first loop 14, and male buckle element 26, which is adjustably secured to second loop 18. Sleeve 28, affixed to strap 12, includes sleeve top surface 30 and sleeve bottom surface 32, in particular embodiments, but can also be formed by a single continuous element if desired. Sleeve 28 is permanently affixed to strap 12, for example by stitching, in particular embodiments.

Figure 4:
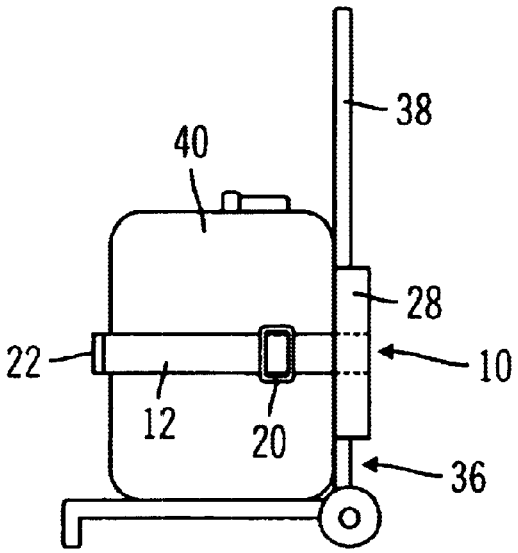
FIGS. 4 and 5 are side and back views of a suitcase secured to a portable luggage cart by means of the embodiment of FIG. 1.
Figure 5:
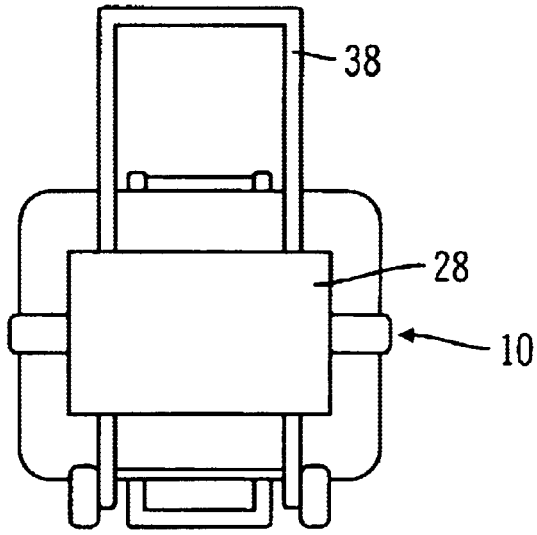

Sleeve 28 defines a cavity 34 into which the handle 28 of a portable luggage cart 36, for example, can be disposed, as shown in FIGS. 3–5.

In other particular embodiments, the flexible extended element is an extensible cord, such as a bungee cord. The sleeve 28, in other particular embodiments can adjustably engage the flexible extended element 12, for example by means such as loops through which the flexible extended element is inserted.

Use of the foregoing embodiment of the inventive luggage slip strap is illustrated in FIGS. 4 and 5. Sleeve 28 of luggage slip strap 10 is disposed around handle 38 of portable luggage cart 36. An article, for example a suitcase 40, is placed on the portable luggage cart 36, and strap 12 of luggage slip strap 10 is wrapped horizontally about suitcase 40. Buckles 16 and 20 are used to size loops 14 and 18, respectively, in order to obtain a secure fit. Buckle 24 (see FIG. 1) secures luggage slip strap 10 about suitcase 40 and secures suitcase 40 to portable luggage cart 36.

Figure 6:
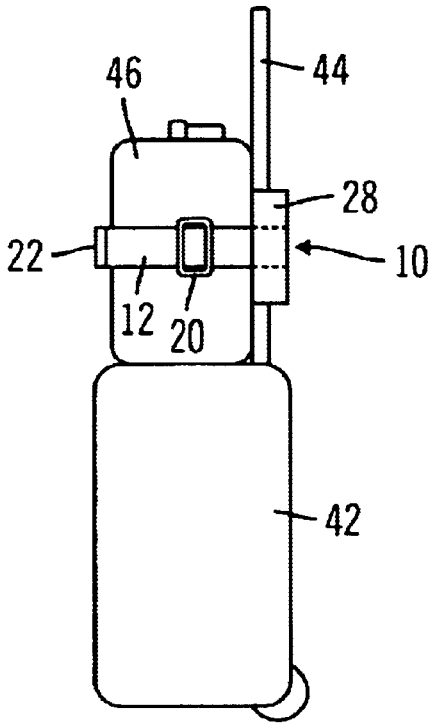
FIG. 6 is a side view of a suitcase having an integral handle, showing the use of the embodiment of FIG. 1 in securing a second suitcase to the integral handle of the first suitcase.

In FIG. 6, luggage slip strap 10 is used with a suitcase 42 with an integral handle 44 and a second article, such as a second suitcase 46, is secured to integral handle 44 in a manner similar to that shown in FIGS. 4 and 5. Sleeve 28 is disposed about integral handle 44 as shown.

What is claimed is:

1. A luggage slip strap comprising:

a flexible extended element having first and second ends and a long axis, and a distinct sleeve affixed to the flexible extended element, the sleeve defining a cavity having an axis generally perpendicular to the long axis of the flexible extended element, the sleeve being permanently affixed to the flexible extended element preventing relative motion of the flexible extended element with respect to the sleeve.

2. The luggage slip strap of claim 1, further comprising means for securing the first and second ends of the flexible extended member to each other.

3. The luggage slip strap of claim 2 wherein at least one of the first and second ends of the flexible extended element comprises a loop.

4. The luggage slip strap of claim 3 wherein each loop is independently defined by an adjustable buckle.

5. The luggage slip strap of claim 3 wherein the securing means comprise a buckle comprising a female buckle element adjustably secured to the first loop and a male buckle element adjustably secured to the second loop.

6. The luggage slip strap of claim 1 wherein the flexible extended element is a strap.

7. The luggage slip strap of claim 6 wherein the first and second ends of the flexible extended element comprises a loop.

8. The luggage slip strap of claim 6 wherein the loop is defined by an adjustable buckle.

9. The luggage slip strap of claim 1 wherein the flexible extended element and the sleeve have widths in the direction of the axis of the cavity, and wherein the width of the sleeve exceeds the width of the flexible extended element.

10. The luggage slip strap of claim 1 wherein the sleeve comprises top and bottom surfaces, the top and bottom surfaces each having a pair of opposed edges extending in a direction generally parallel to the axis of the cavity, wherein each of the edges of the top surface extending in the direction generally parallel to the axis of the cavity is adjacent and affixed to the corresponding edge of the bottom surface, and wherein the bottom surface of the sleeve is affixed to the flexible extended element.

11. A method for securing an article to an apparatus having a handle, the method comprising the steps of:

providing a luggage slip strap comprising:

a flexible extended element having a long axis and first and second ends, and a sleeve affixed to the flexible extended element, the sleeve defining a cavity having an axis generally perpendicular to the long axis of the flexible extended member, placing the sleeve about the handle, and securing around the article the flexible extended element.

12. The method of claim 11 wherein the apparatus is a luggage cart.

13. The method of claim 11 wherein the apparatus is a suitcase having an integral handle.

14. The method of claim 11 wherein the article is an item of luggage.

15. The method of claim 11 wherein the sleeve comprises top and bottom surfaces, the top and bottom surfaces each having a pair of opposed edges extending in a direction generally parallel to the axis of the cavity, wherein each of the edges of the top surface extending in the direction generally parallel to the axis of the cavity is adjacent and affixed to the corresponding edge of the bottom surface, and wherein the bottom surface of the sleeve is affixed to the flexible extended element.

16. The method of claim 11 wherein the flexible extended element and the sleeve have widths in the direction of the axis of the cavity, and wherein the width of the sleeve exceeds the width of the flexible extended element.

17. A luggage slip strap comprising: a flexible extended element having first and second ends and a long axis, and a sleeve affixed to the flexible extended element, the sleeve defining a cavity having an axis generally perpendicular to the long axis of the flexible extended element, wherein the sleeve comprises top and bottom surfaces, the top and bottom surfaces each having a pair of opposed edges extending in a direction generally parallel to the axis of the cavity, wherein each of the edges of the top surface extending in the direction generally parallel to the axis of the cavity is adjacent and affixed to the corresponding edge of the bottom surface, and wherein the bottom surface of the sleeve is affixed to the flexible extended element.

18. A luggage slip strap comprising: a flexible extended element having first and second ends and a long axis, and a sleeve affixed to the flexible extended element, the sleeve defining a cavity having an axis generally perpendicular to the long axis of the flexible extended element, wherein the flexible extended element and the sleeve have widths in the direction of the axis of the cavity, and wherein the width of the sleeve exceeds the width of the flexible extended element.

* * * * *